US011813617B2

(12) United States Patent
Loreth et al.

(10) Patent No.: US 11,813,617 B2
(45) Date of Patent: Nov. 14, 2023

(54) ELECTRODE ELEMENTS OF HIGH RESISTIVITY FOR TWO-STEP ELECTROFILTER

(71) Applicants: Eurus AirTech AB, Åkersberga (SE); LightAir Holding AB, Solna (SE)

(72) Inventors: Andrzej Loreth, Åkersberga (SE); Peter Holmberg, Ramsjö (SE)

(73) Assignee: LightAir Holding AB, Solna (SE)

( * ) Notice: Subject to any disclaimer, the term of this patent is extended or adjusted under 35 U.S.C. 154(b) by 267 days.

(21) Appl. No.: 17/047,624

(22) PCT Filed: Mar. 11, 2019

(86) PCT No.: PCT/SE2019/050214

§ 371 (c)(1),
(2) Date: Oct. 14, 2020

(87) PCT Pub. No.: WO2019/203708

PCT Pub. Date: Oct. 24, 2019

(65) Prior Publication Data

US 2021/0154680 A1 May 27, 2021

(30) Foreign Application Priority Data

Apr. 18, 2018 (SE) ..... 1850448-0

(51) Int. Cl.
*B03C 3/47* (2006.01)
*B03C 3/12* (2006.01)
(Continued)

(52) U.S. Cl.
CPC ..... *B03C 3/47* (2013.01); *B03C 3/08* (2013.01); *B03C 3/12* (2013.01); *B03C 3/41* (2013.01); *B03C 3/60* (2013.01)

(58) Field of Classification Search
CPC .... B03C 3/47; B03C 3/08; B03C 3/12; B03C 3/41; B03C 3/60; B03C 3/64; B03C 3/45; B03C 3/40; B03C 3/38
See application file for complete search history.

(56) References Cited

U.S. PATENT DOCUMENTS 3,487,610 A * 1/1970 Burton ..... B03C 3/28 156/1
3,918,939 A * 11/1975 Hardt ..... H05F 3/02 96/99

(Continued)

FOREIGN PATENT DOCUMENTS

CN 102974461 A * 3/2013 ..... B03C 3/06
CN 103752411 A * 4/2014

(Continued)

*Primary Examiner* — Christopher P Jones
*Assistant Examiner* — Sonji Turner
(74) *Attorney, Agent, or Firm* — BLANK ROME LLP

(57) ABSTRACT

A device comprising a group of electrode elements for a condenser separator of a two-step electrofilter, which group of electrode elements comprises at least two electrode elements in the form of strips or flat planar sheets, the electrode elements being mostly comprised of a core. At least one of the electrode elements or group of electrode elements is formed of at least two different polymers with different electrical properties. A first portion of the electrode element that is disposed closest to an adjacent second electrode element in the condenser separator is formed of an insulating polymer, and a second portion of the electrode element is comprised of at least one current conductive element in the form of a thin coating on the core of the electrode element, or is embedded in the core.

5 Claims, 4 Drawing Sheets

(51) Int. Cl.

| | |
|---|---|
| ***B03C 3/08*** | (2006.01) |
| ***B03C 3/41*** | (2006.01) |
| ***B03C 3/60*** | (2006.01) |

(56) References Cited

U.S. PATENT DOCUMENTS

| | | | | | |
|---|---|---|---|---|---|
| 4,354,861 | A * | 10/1982 | Kalt | B03C 3/60 | 427/121 |
| 4,477,268 | A * | 10/1984 | Kalt | B03C 3/60 | 96/99 |
| 5,202,179 | A * | 4/1993 | Kasahara | H02N 13/00 | 428/323 |
| 5,466,279 | A * | 11/1995 | Hattori | B03C 3/47 | 96/100 |
| 5,766,318 | A * | 6/1998 | Loreth | B03C 3/60 | 96/69 |
| 6,090,189 | A * | 7/2000 | Wikstrom | B03C 3/64 | 96/96 |
| 6,117,216 | A * | 9/2000 | Loreth | B03C 3/08 | 96/100 |
| 6,241,810 | B1 * | 6/2001 | Wikstrom | B03C 3/64 | 96/69 |
| 6,749,669 | B1 * | 6/2004 | Griffiths | B03C 3/28 | 96/99 |
| 7,081,155 | B2 * | 7/2006 | Loreth | B03C 3/47 | 96/87 |
| 8,349,052 | B2 * | 1/2013 | Noh | B03C 3/47 | 95/79 |
| 9,623,422 | B2 * | 4/2017 | Overdahl | B03C 3/76 | |
| 2013/0061754 | A1 * | 3/2013 | Lev | B03C 3/368 | 96/15 |

FOREIGN PATENT DOCUMENTS

| | | | |
|---|---|---|---|
| CN | 105536994 | B | * 12/2017 |
| GB | 646577 | A | * 11/1950 |
| JP | 2008-12526 | A | 1/2008 |
| JP | 2010-29839 | A | 2/2010 |
| JP | 2010-63964 | A | 3/2010 |
| WO | WO 96/24437 | A1 | 8/1996 |
| WO | WO 00/61293 | A1 | 10/2000 |

* cited by examiner

ELECTRODE ELEMENTS OF HIGH RESISTIVITY FOR TWO-STEP ELECTROFILTER

The invention relates to a device comprising a group of electrode elements for two-step electrofilters in a condenser separator, which group of electrode elements comprises at least two strip shaped electrode elements or two groups of planar disc-shaped electrode elements.

STATE OF THE ART

Until now, the dominant technique for purifying airborne particulate pollutants is and has been so-called mechanical filters, of the Hepa type or the like.

These are constructed around thin fibres of various materials and are characterized in that the thinner the fibres used are, the better separation may be achieved, especially with respect to small particles. With increasing air purification efficiency, mechanical filters also exhibit undesirable increasing pressure drops through the filter with increasing purification capability.

The development of two-step electrofilters has led to efficient air purifiers equipped with so-called condenser separators of high resistivity comprising high resistive electrode elements mainly made of specially designed paper. These air cleaners can be designed as electrode elements in the form of thin sheets (discs) arranged with gap spacing with respect to each other or as a cylindrical body formed of two strip-like electrode elements.

In the Swedish patent application 9602211-6, a two-step electrofilter with an ionization section is described which, downstream in the air flow direction, is followed by a so-called condenser separator.

The condenser separator consists of two strip-shaped electrode elements which are multiply wound around a bobbin with a gap distance "d" between the respective electrode elements. Such a condenser separator has a substantially cylindrical body. The air flow through the condenser separator is directed in the axial direction and through slots "d" that are open to an air flow between adjacent electrode elements.

The condenser separator according to the above can advantageously be designed with a specially elaborated paper in accordance with the Swedish patent No. SE 0103684-7. In practice, there is no limit to the size of the filter units that can be made with respect to the diameter of the condenser separator and thus large amounts of air can be handled by a device provided with only one condenser separator. However, the influence of moisture on the electrode elements of the condenser separator constitutes a practical limiting factor, which also affects the efficiency.

OBJECTS AND FEATURES OF THE INVENTION

It is an object of the present invention to provide a suitable design of the electrode elements of a condenser separator of the kind presented above (electrode elements of high resistivity or groups thereof) with better operating liability with respect to moisture influence, but also with increased mechanical properties than corresponding electrode elements comprised of cardboard.

This is achieved in accordance with the invention by means of a group of electrode elements for two-step electrofilters in a condenser separator, which group of electrode elements comprises at least two electrode elements in the form of strips or flat planar sheets, the electrode elements mostly being comprised of a core, and wherein at least one of the electrode elements or group of electrode elements is formed of at least two different polymers with different electrical properties, wherein the portion of an electrode element that is arranged closest to an adjacent second electrode element of the condenser separator is formed of a polymer, wherein a second part of the electrode elements is comprised of at least one current conductive element in the form of a polymer in a thin coating on the core of the electrode elements, or is embedded in the core with an cxtcnsion width and depth that is substantially smaller than the width and the depth of the core.

In a specific embodiment, the volume resistivity of the polymer in the portion of the electrode element that is arranged closest to the adjacent second electrode element in the condenser separator should be at least $1\times10^{11}$ ohm-cm and preferably not less than $1\times10^{13}$ ohm-cm.

In a specific embodiment, the surface resistivity of the current conductive elements should be less than $1\times10^{8}$ ohm/sq and preferably less than $1\times10^{5}$ ohm/sq, and the volume resistivity should be less than $1\times10^{7}$ ohm-cm and preferably less than $1\times10^{4}$ ohm-cm.

In a specific embodiment, the portion of an electrode element that is arranged closest to the adjacent second electrode element in the condenser separator is comprised of an insulation layer.

In a specific embodiment, the insulation layer also encloses the edge sections of the respective electrode elements.

In a specific embodiment, groups of the electrode elements are formed as planar sheets, wherein multiple current conductive elements are arranged offset relative to each other and perpendicular to the intended air flow direction through the condenser separator.

In a specific embodiment, several separate connections to a high voltage source are provided by edge connection of the respective current conductive elements by means of a conductive material.

In a specific embodiment, the core of the electrode elements is thinner than 0.7 mm and preferably thinner than 0.4 mm.

In a specific embodiment, the current conductive elements on the electrode elements or on the groups of electrode elements are offset with respect to each other in such a way that two adjacent electrode elements do not have current conductive elements located at the same corresponding position.

DETAILED DESCRIPTION

Figure 1:
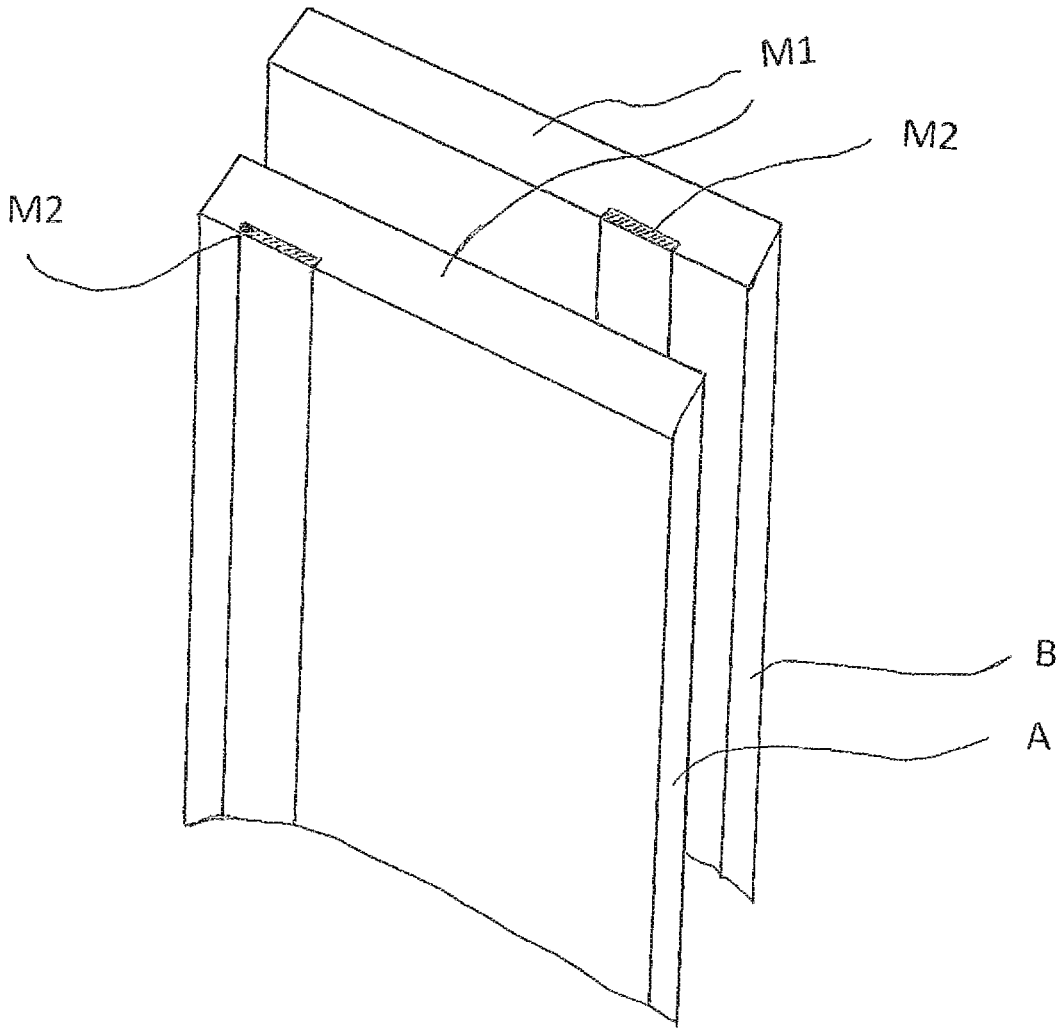
FIG. 1 shows a first embodiment of the present invention.

As shown in FIG. 1, the electrode elements A, B in the form of thin strips consisting of two polymers are assembled with each other during the manufacturing process.

A major layer consists of a thin core M1 of a polymer of high ohmic resistance and with a surface resistivity that is greater than $1\times10^{10}$ ohm/sq or a volume resistivity that is greater than $1\times10^{9}$, and preferably with a surface resistivity that is greater than $1\times10^{12}$ ohm/sq or a volume resistivity that is greater than $1\times10^{11}$.

At least one current conductive element M2 of a conductive polymer extends to one edge section of the core M1, with an extension that is substantially smaller than the extension of the core M1 with respect to both the width and the thickness. In the shown embodiment, the current conductive elements M2 run along the whole length of the electrode element A, B, on one side of said electrode element.

The surface resistivity of the current conductive elements M2 is preferably less than $1\times10^{8}$ ohm/sq or their volume resistivity should be less than $1\times10^{7}$ ohm-cm and preferably less than $1\times10^{5}$ ohm/sq and $1\times10^{4}$ ohm-cm, respectively.

If two electrode elements in a condenser separator are designed in accordance with the present invention, these should advantageously be mirror images of one another, i.e. the current conductive elements M2 in the respective electrode elements A, B should be arranged at opposite edge sections. I.e. if a current conductive element M2 on a first side of a first electrode element A is located at a first distance from the first edge of the electrode element A and thus clearly farther away from the second edge of the electrode element A, then a current conductive element M2 on an adjacent second electrode element B should advantageously be located at said first distance from the second edge of the electrode element B and hence clearly farther away from the first edge of the electrode element B.

Figure 2:
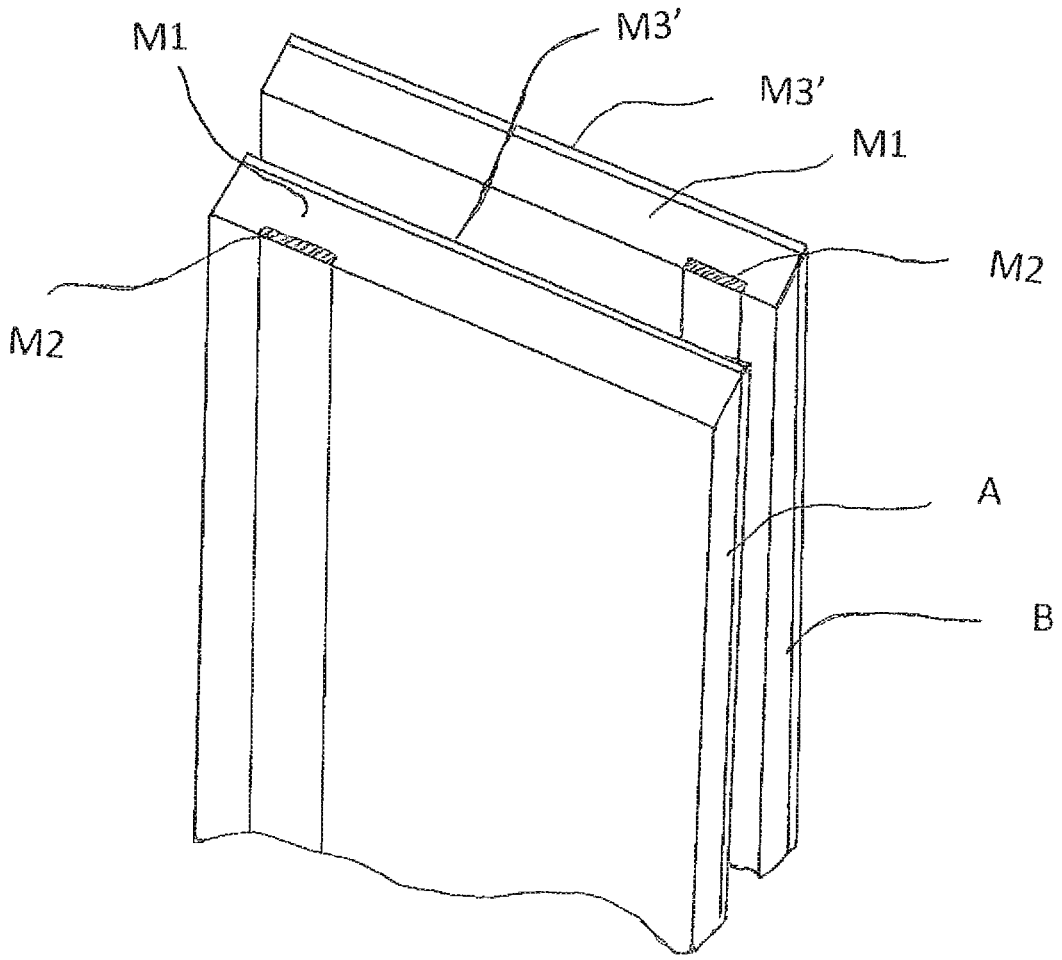
FIG. 2 shows a second embodiment of the present invention, in which the electrode elements are coated on at least one side with a thin film of insulating polymer.

FIG. 2 shows a modified embodiment of the invention wherein the respective electrode elements A, B, at least on one side thereof, are coated with a thin film of insulating polymer M3', i.e. a polymer with higher surface resistivity than $1\times10^{12}$ ohm/sq and at least 10 times as high surface resistivity (or volume resistivity) as the resistivity of the core M1.

Preferably, the back side of the electrode elements A, B are coated with said thin film of insulating polymer M3', the back side being the side electrode elements A, B which are not coated with current conductive elements M2.

Figure 3:
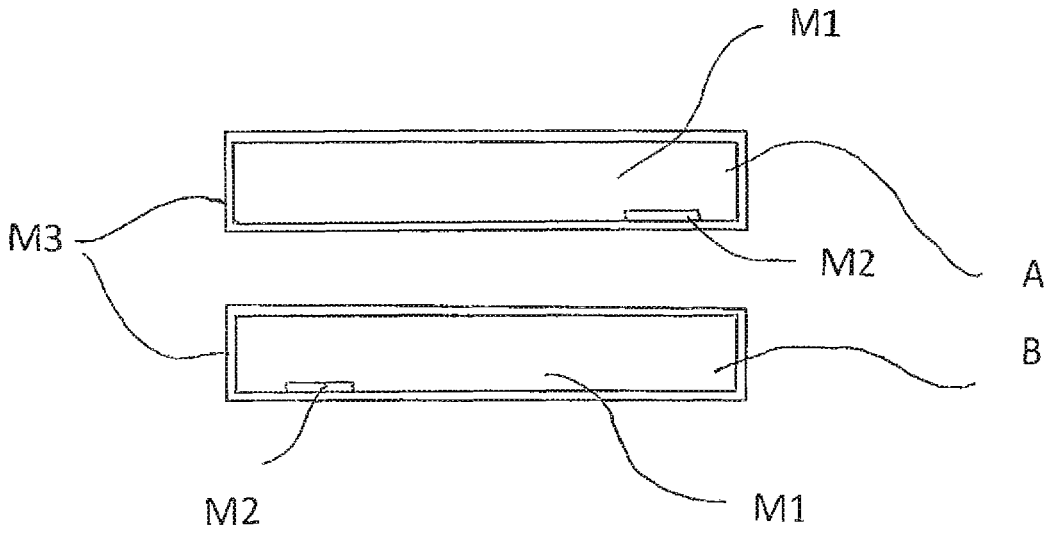
FIG. 3 shows a third embodiment of the present invention, in which a thin film of insulating polymer surrounds the entirety of each of the electrode elements.

FIG. 3 shows yet another modified embodiment of the embodiment shown in FIG. 2.

In this embodiment, an insulating polymer M3 is arranged to enclose the entire electrode elements A or B, one of them or both, including its edge sections and including the current conductive elements M2.

Possible Modifications

Figure 4:
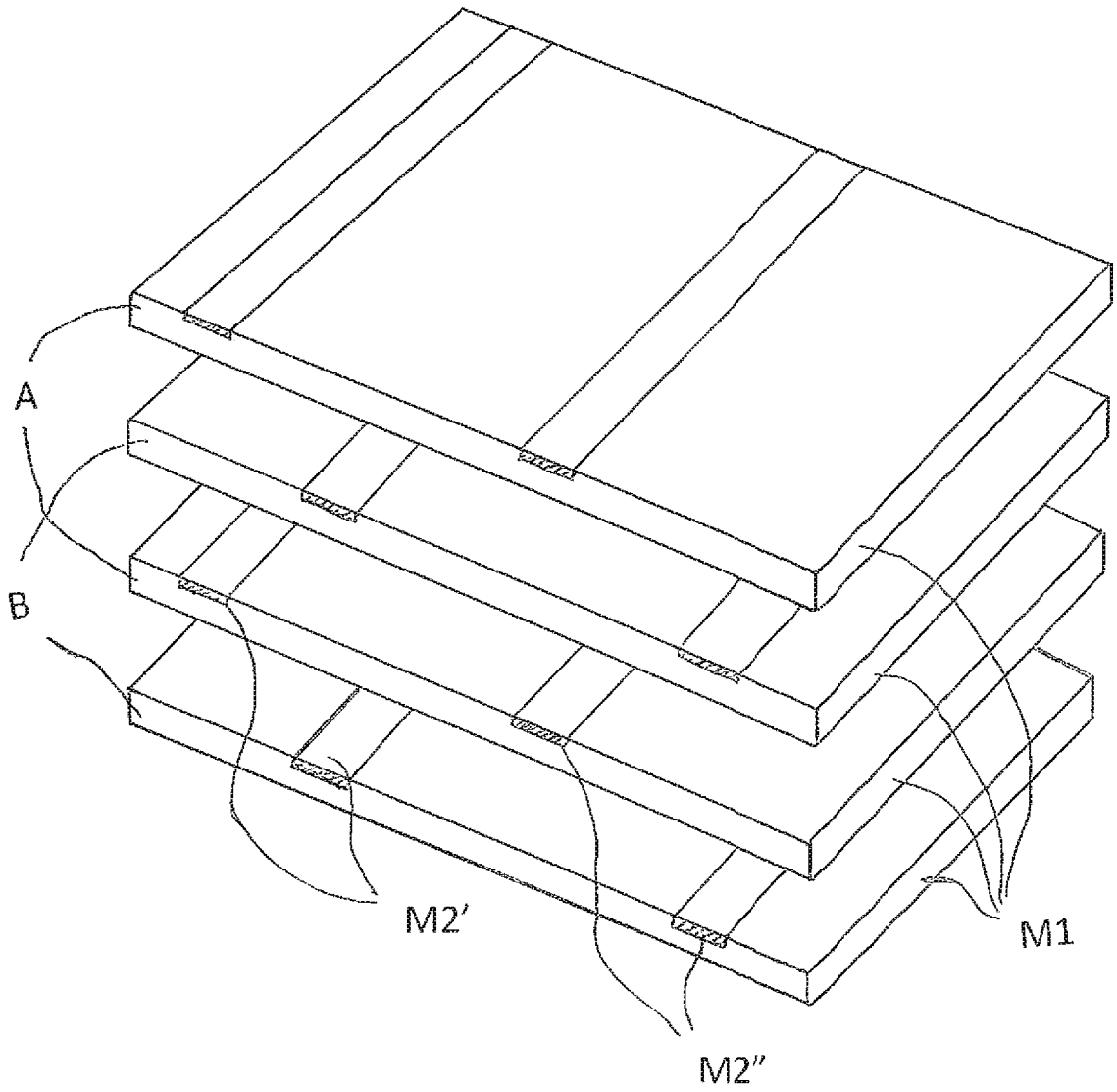
FIG. 4 shows a modification of the present invention, in which the electrode elements each include a plurality of current conductive elements.

Of course, it is not necessary that the electrode elements A, B have the shape of long strip-like elements. As illustrated in FIG. 4, the elements A, B may be in the form of rectangular/square sheets consisting of the core M1 and preferably several current conductive elements M2', M2" arranged at a distance from each other and embedded in the core or arranged as a thin coating on the core M1. FIG. 4 schematically shows flat electrode elements A, B with several current conductive elements M2' and M2".

In the embodiment shown in FIG. 4 the current conductive elements M2, M2', M2" are all arranged at the same corresponding side. However, the present invention is not limited to current conductive elements M2, M2', M2" provided only on one side of core M1. Current conductive elements M2, M2', M2" may very well be provided on both sides of the core M1.

With several current conductive elements (coatings) M2, M2', M2", several individual high voltage connections can be arranged, which is of particular importance when the electrode elements in question are flat electrode elements arranged with a gap with respect to each other in a condenser separator with a square or rectangular inlet area. In such an embodiment, the current conductive elements M2, M2', M2" should preferably be arranged perpendicular to the air flow direction L through the condenser separator, as shown in FIG. 4.

With a mutual displacement of the current conductive elements on the closest electrode elements A, B, the respective groups of the electrode elements A, B can be connected to different poles of the high-voltage source, preferably with an edge connection formed of a conductive material such as conductive rubber, conductive foam plastic, conductive hot-melt adhesive or the like.

For example, the current conductive coating M2, M2', M2" may be Polypropylene specified as PP 1379 with a volume resistivity of less than $1\times10^{3}$ ohm-cm and a surface resistivity of less than $1\times10^{4}$ ohm/sq.

The core M1 can, for example, be formed of polypropylene with a volume resistivity that is preferably greater than $1\times10^{10}$ ohm-cm.

The invention claimed is:

1. A device comprising a group of electrode elements for a condenser separator of a two-step electrofilter, the group of electrode elements comprises at least two electrode elements, each consisting of two different polymers, wherein:
   a. the electrode elements are provided in the form of strips or groups of flat sheets,
   b. the electrode elements include a core constituting a majority of each of the electrode elements,
   c. at least one current conductive element is provided on a first side of each of the electrode elements either in the form of a polymer coated on the core of the electrode elements, or embedded in the core, wherein the at least one current conductive element extends the entire length of the first side of each of the electrode elements,
   d. the at least one current conductive element has smaller dimensions in width and depth than corresponding dimensions of the core in width and depth,
   e. a first portion of a back side of each of the electrode elements that is opposite to the first side of each of the electrode elements and arranged closer to an adjacent one of the electrode elements is formed of an insulating polymer,
   f. a second portion of the electrode elements comprises at least one said current conductive element,
   g. the electrode elements are offset with respect to each other in such a way that no two adjacent electrode elements have the current conductive element located at a same corresponding position, and
   h. the current conductive element on the first side of each of the first electrode elements is located at a first distance from a first edge of the respective electrode element and farther away than the first distance from a second edge of the respective electrode element, and the current conductive element on the adjacent one of the second electrode elements is located at the first distance from the second edge of the respective electrode element and farther away than the first distance from the first edge of the respective electrode element.

2. The device according to claim 1, wherein an insulation layer encloses edge sections of the electrode elements.

3. The device according to claim 1, wherein several of the current conductive elements are offset with respect to each other and perpendicular to air flow direction through the condenser separator.

4. The device according to claim 3, wherein several separate connections to a high voltage source are provided by an edge connection of respective current conductive elements by means of a conductive material.

5. The device according to claim I, wherein the core of the electrode elements is thinner than 0.7 mm.

* * * * *